US010518531B2

(12) United States Patent
Higuchi et al.

(10) Patent No.: US 10,518,531 B2
(45) Date of Patent: Dec. 31, 2019

(54) LIQUID EJECTION HEAD SUBSTRATE

(71) Applicant: CANON KABUSHIKI KAISHA, Tokyo (JP)

(72) Inventors: Hiroshi Higuchi, Atsugi (JP); Toshiyasu Sakai, Kawasaki (JP); Masataka Kato, Hiratsuka (JP); Takayuki Kamimura, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/009,459

(22) Filed: Jun. 15, 2018

(65) Prior Publication Data

US 2018/0361742 A1 Dec. 20, 2018

(30) Foreign Application Priority Data

Jun. 20, 2017 (JP) ..... 2017-120616

(51) Int. Cl.
*B41J 2/01* (2006.01)
*B41J 2/14* (2006.01)

(52) U.S. Cl.
CPC ..... *B41J 2/14064* (2013.01)

(58) Field of Classification Search
CPC ..... B41J 2/14064; B41J 2/14032; B41J 2/14145; B41J 2/1404; B41J 2002/14467
See application file for complete search history.

(56) References Cited

U.S. PATENT DOCUMENTS 6,450,335 B1 * 9/2002 Yates ..... 347/65
8,518,725 B2 8/2013 Terasaki et al.
2012/0282715 A1 11/2012 Terasaki et al.

FOREIGN PATENT DOCUMENTS

JP 2011-161915 A 8/2011

* cited by examiner

*Primary Examiner* — Juanita D Jackson
(74) *Attorney, Agent, or Firm* — Venable LLP

(57) ABSTRACT

Provided is a liquid ejection head substrate, in which a plurality of units are arranged. Each of the units includes: a pressure generating element formed on a first surface of a support substrate; and a pair of independent liquid chambers, which are formed on both sides of the pressure generating element so as to be opposed to each other, and are opened to the first surface of the support substrate. The liquid ejection head substrate includes, in the support substrate: a first common liquid chamber communicating to a plurality of independent liquid chambers on one side of the pair of independent liquid chambers; a second common liquid chamber communicating to a plurality of independent liquid chambers on another side of the pair of independent liquid chambers; and a partition wall separating the first common liquid chamber and the second common liquid chamber from each other.

15 Claims, 8 Drawing Sheets

LIQUID EJECTION HEAD SUBSTRATE

BACKGROUND OF THE INVENTION

Field of the Invention

The present invention relates to a liquid ejection head substrate. The present invention also relates to a liquid ejection head including the liquid ejection head substrate.

Description of the Related Art

In a recording apparatus in which a liquid droplet is ejected from a liquid ejection head, for example, an ink jet printer, liquid is supplied from a liquid chamber to a pressure generating chamber, and a pressure generating element is applied with energy so that the liquid is ejected from an ejection orifice. There has been known a configuration in which the liquid chamber is divided into a common liquid chamber and an independent liquid chamber, and liquid is supplied independently from the independent liquid chamber to the pressure generating chamber communicating to each ejection orifice to increase nozzle density, to thereby implement high-speed printing. When liquid is supplied from a plurality of independent liquid chambers to one pressure generating chamber, liquid supply performance is improved, and further, an ejection direction of the liquid becomes stable. Therefore, a recorded matter can be formed with high accuracy at a high speed. Through the above-mentioned configuration of the common liquid chamber and the independent liquid chamber, liquid can also be circulated in the pressure generating chamber, and thus the liquid having changed density and viscosity can be discharged, with the result that a recorded matter with stable quality can be formed. In Japanese Patent Application Laid-Open No. 2011-161915, there is disclosed a liquid ejection head having a configuration of the independent liquid chamber and the common liquid chamber.

In the liquid ejection head having the configuration of the independent liquid chamber and the common liquid chamber, there is a case in which a partition wall is formed in the common liquid chamber in order to improve mechanical strength, a heat radiation property, and the like and in order to circulate liquid. When high-speed recording is performed in the above-mentioned configuration, the liquid is required to be rapidly refilled onto a surface of the pressure generating element after one ejection, and hence it is required that the distance (refill distance) from the independent liquid chamber to the pressure generating element be reduced to the extent possible. The refill distance cannot be reduced sufficiently merely by bringing the independent liquid chamber close to the pressure generating element, and can be reduced only by decreasing the width of the partition wall. However, when a partition wall is formed between a pair of independent liquid chambers and the width of the partition wall is decreased in the configuration disclosed in Japanese Patent Application Laid-Open No. 2011-161915, the mechanical strength of the partition wall is liable to decrease. As a result, for example, a yield decreases during a manufacturing process for a liquid ejection head substrate, and a liquid ejection head is liable to be damaged when receiving vibration and impact. Thus, productivity and reliability of the liquid ejection head may be deteriorated.

SUMMARY OF THE INVENTION

According to one embodiment of the present invention, there is provided a liquid ejection head substrate in which a plurality of units are arranged, each of the plurality of units including: a pressure generating element formed on a first surface of a support substrate; and a pair of independent liquid chambers, which are formed on both sides of the pressure generating element so as to be opposed to each other, and are opened to the surface of the first support substrate, the liquid ejection head substrate including, in the support substrate: a first common liquid chamber communicating to a plurality of independent liquid chambers on one side of the pair of independent liquid chambers; a second common liquid chamber communicating to a plurality of independent liquid chambers on another side of the pair of independent liquid chambers; and a partition wall separating the first common liquid chamber and the second common liquid chamber from each other, wherein the partition wall extends in an arrangement direction of the pressure generating elements, wherein the partition wall has a width smaller than a distance between the pair of independent liquid chambers, and wherein the partition wall has a shape inflected regularly in the arrangement direction in plan view of the support substrate in a thickness direction of the support substrate.

Further features of the present invention will become apparent from the following description of exemplary embodiments with reference to the attached drawings.

BRIEF DESCRIPTION OF THE DRAWINGS

FIG. 1A and FIG. 1B are each a view for illustrating a liquid ejection head substrate according to a first embodiment of the present invention, in which FIG. 1A is a schematic plan view of the liquid ejection head substrate when viewed from a common liquid chamber side, and FIG. 1B is a schematic sectional view taken along the line 1B-1B of FIG. 1A.

FIG. 2A and FIG. 2B are each a view for illustrating a liquid ejection head substrate according to a modification example of the first embodiment, in which FIG. 2A is a schematic plan view of the liquid ejection head substrate when viewed from the common liquid chamber side, and FIG. 2B is an enlarged view thereof.

FIG. 3A and FIG. 3B are each a view for illustrating a liquid ejection head substrate according to a second embodiment of the present invention, in which FIG. 3A is a schematic plan view of the liquid ejection head substrate when viewed from a common liquid chamber side, and FIG. 3B is a schematic sectional view taken along the line 3B-3B of FIG. 3A.

FIG. 4A and FIG. 4B are each a view for illustrating a liquid ejection head substrate according to a modification example of the second embodiment, in which FIG. 4A is a schematic plan view of the liquid ejection head substrate when viewed from the common liquid chamber side, and FIG. 4B is an enlarged view thereof.

DESCRIPTION OF THE EMBODIMENTS

Preferred embodiments of the present invention will now be described in detail in accordance with the accompanying drawings.

It is an object of the present invention to provide a liquid ejection head substrate enabling high-speed recording by reducing a refill distance without decreasing mechanical strength of a partition wall of a common liquid chamber in a liquid ejection head having a configuration of an independent liquid chamber and the common liquid chamber.

Now, a liquid ejection head substrate according to each of embodiments of the present invention is described with reference to the drawings. In the following embodiments, specific description is given in order to sufficiently describe the present invention. However, the specific description is merely a technically preferred example and does not particularly limit the scope of the present invention.

Figure 6A:
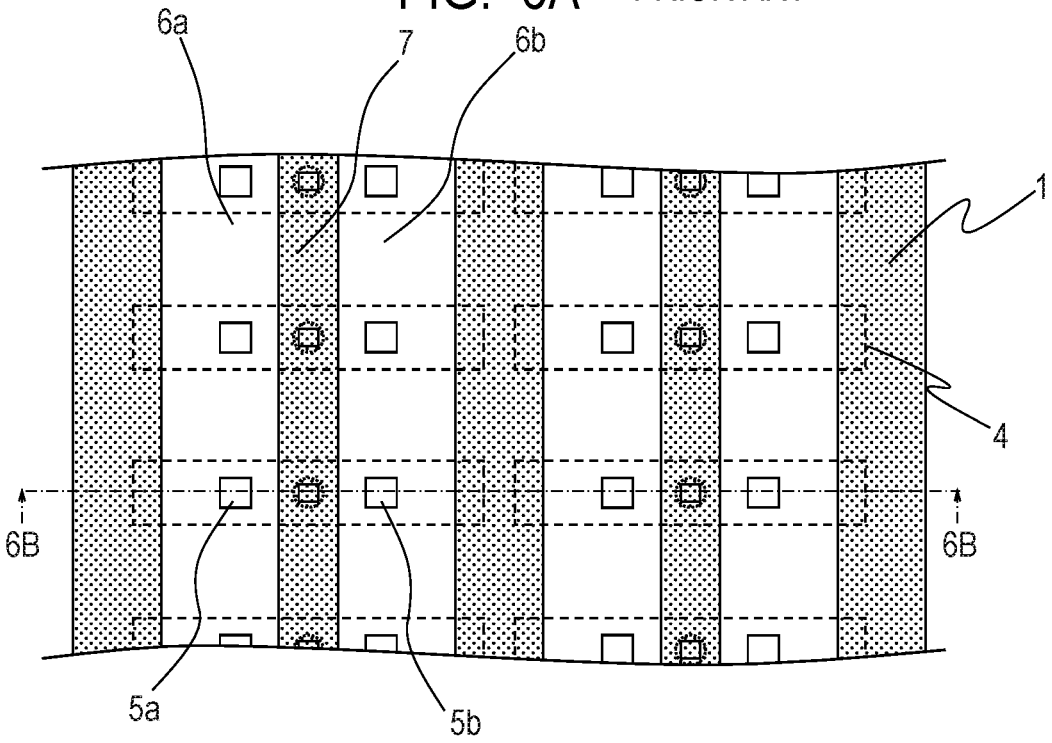
FIG. 6A PRIOR ART
FIG. 6A is a schematic plan view of a related-art liquid ejection head substrate when viewed from a common liquid chamber side.
Figure 6B:
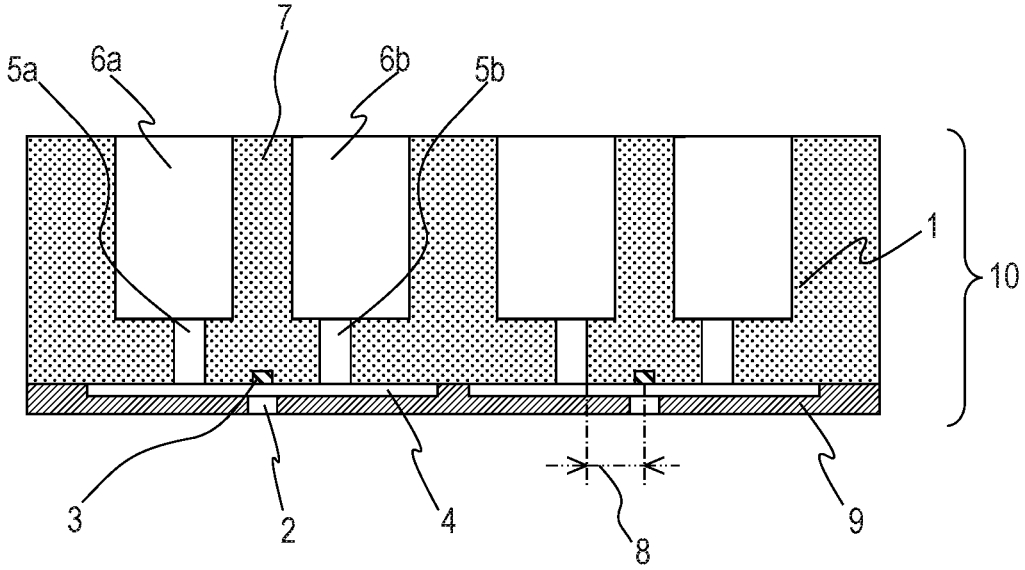
FIG. 6B PRIOR ART
FIG. 6B is a schematic sectional view taken along the line 6B-6B of FIG. 6A.

FIG. 6A and FIG. 6B are each a view for illustrating an example of a related-art liquid ejection head substrate 10 having a flow passage configuration for circulating a liquid. FIG. 6A is a schematic plan view of the liquid ejection head substrate when viewed from a common liquid chamber side. FIG. 6B is a schematic sectional view taken along the line 6B-6B of FIG. 6A. As illustrated in FIG. 6B, liquid is supplied to a pressure generating chamber 4 through a pair of independent liquid chambers 5*a* and 5*b* and common liquid chambers coupled to the independent liquid chambers 5*a* and 5*b* (for the sake of convenience, the common liquid chamber coupled to the independent liquid chamber 5*a* is referred to as "first common liquid chamber 6*a*", and the common liquid chamber coupled to the independent liquid chamber 5*b* is referred to as "second common liquid chamber 6*b*"). A pressure generation element 3 is driven to eject the liquid from an ejection orifice 2. The pressure generating element 3 is arranged on a first surface of a support substrate 1, and the pair of independent liquid chambers 5*a* and 5*b* (sometimes collectively referred to as "independent chamber 5") opened to the first surface of the support substrate 1 are arranged at positions opposed to each other on both sides of the pressure generating element 3. The first common liquid chamber 6*a* and the second common liquid chamber 6*b* (sometimes collectively referred to as "common liquid chamber 6") are opened to a second surface opposed to the first surface of the support substrate 1, and the common liquid chamber and the independent liquid chamber are combined to penetrate through the support substrate 1. The common liquid chamber and the independent liquid chamber are each formed so as to have a substantially perpendicular wall surface in a thickness direction of the support substrate 1. An ejection orifice member 9 defining the pressure generating chamber 4 and the ejection orifice 2 is arranged on the first surface of the support substrate. In this case, the ejection orifice 2, the pressure generating element 3, the pressure generating chamber 4, and the pair of independent liquid chambers 5*a* and 5*b* are defined as one unit, and a plurality of units are arranged in an up-and-down direction of the drawing sheet as illustrated in FIG. 6A. Each common liquid chamber extends in the arrangement direction of the units and is coupled to the independent liquid chamber of at least one unit. The first common liquid chamber 6*a* and the second common liquid chamber 6*b* are separated from each other by a partition wall 7 extending in the arrangement direction of the units. Of sets including one of two independent liquid chambers and one of two common liquid chambers and coupled to one pressure generating chamber, one set has a function of supplying the liquid, and the other set has a function of discharging the liquid. In FIG. 6A and FIG. 6B, there is illustrated a mode in which the units are arranged in two rows. However, the number of rows is not limited thereto, and the same is also applied to the configuration of the present invention described below.

In order to form liquid chambers each having a substantially perpendicular wall surface on a silicon substrate serving as a support substrate, a dry etching method is performed. In particular, as a method enabling deep drilling, a Bosch process is known. For example, the Bosch process involves repeatedly performing formation of a deposition film with fluorocarbon-based gas plasma rich in C (carbon), for example, C4F8, removal of the deposition film outside of a side surface with use of an ion component of SF6 plasma, and silicon etching with use of a radical. In particular, in an independent liquid chamber having a large aspect ratio represented by "etching depth/opening width"), the Bosch process is an effective method.

One of requirements for a liquid ejection head substrate enabling high-speed printing is that liquid can be rapidly refilled onto the surface of the pressure generating element 3 after one ejection. This requirement can be satisfied by a short distance from an opening end of the independent liquid chamber on the pressure generating element side to a center of the pressure generating element, that is, a short refill distance 8. When the refill distance 8 is long, filling speed of the liquid after ejection is not sufficiently high to be ready in time for the subsequent ejection, and the pressure generating element 3 generates thermal energy to cause film boiling in the liquid. In the case of a thermal head configured to eject the liquid, a dry heating state is caused, with the result that printing cannot be performed. In particular, when the pressure generating chamber 4 and the ejection orifice member 9 are formed by photolithography, the pressure generating chamber 4 has a height of at most about tens of microns, with a flow passage section area being small and a flow resistance being large, and hence the refilling speed becomes low. Thus, in the liquid ejection head substrate enabling high-speed printing, in order to further reduce the refill distance 8, it is required to bring the independent liquid chamber 5 having a small flow resistance closer to the pressure generating element 3. The refill distance 8 is generally about ten times the height of the pressure generating chamber 4. Therefore, it is desired that the refill distance 8 be shorter, for example, eight times or less the height of the pressure generating chamber 4. It is more preferred that the distance from the opening end of the independent liquid chamber on the pressure generating element side to an end portion of the pressure generating element be brought close to zero.

Figure 7A:
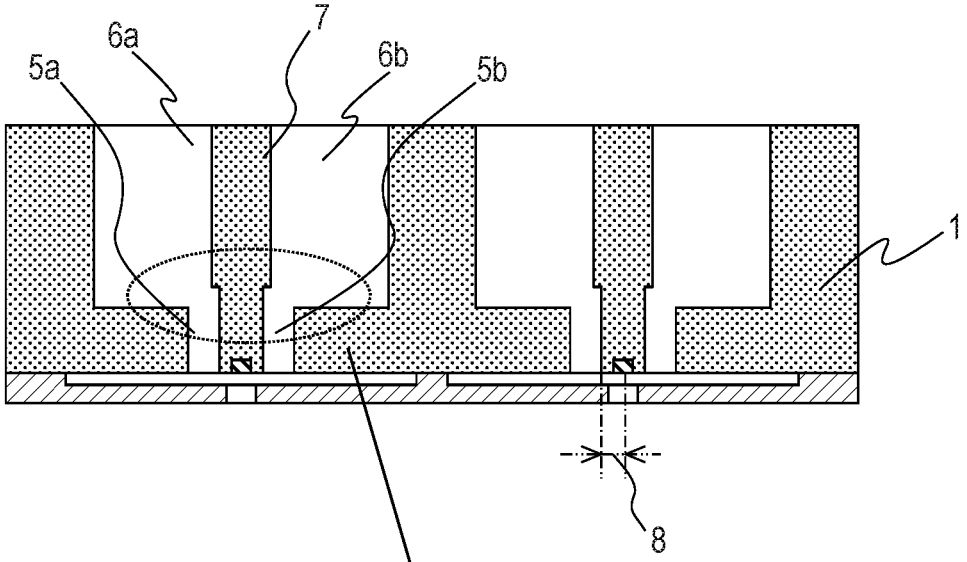
FIG. 7A PRIOR ART
FIG. 7A is a schematic sectional view of a liquid ejection head substrate in which an independent liquid chamber and a common liquid chamber are connected to each other in a crank shape.
Figure 7B:
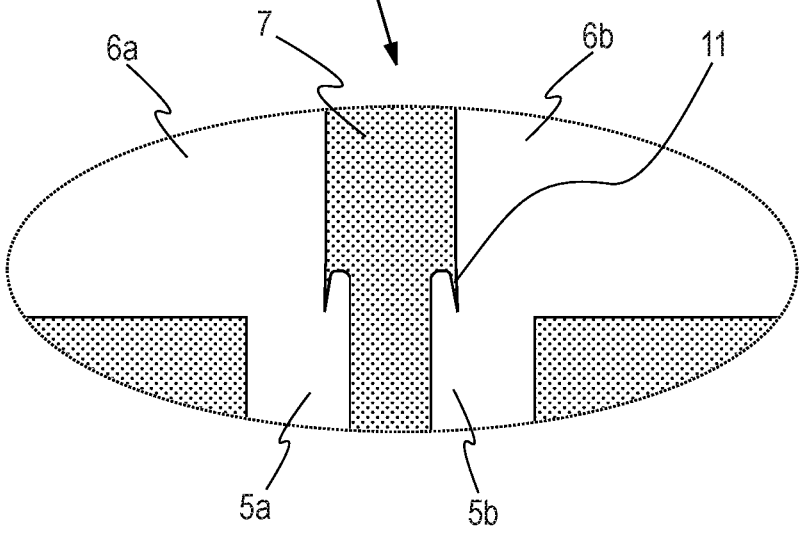
FIG. 7B PRIOR ART
FIG. 7B is a partially enlarged view thereof for illustrating an etching defect occurring in the connection portion.

It is simply conceivable to bring only the independent liquid chamber 5 close to the pressure generating element 3 as illustrated in FIG. 7A and FIG. 7B. However, depending on the reduction in distance, the connection portion between the independent liquid chamber 5 and the common liquid chamber 6 may have a crank shape (FIG. 7A and FIG. 7B). For example, the common liquid chamber 6 is processed from a back surface (second surface) of the support substrate 1, and the independent liquid chamber 5 is processed into a crank shape by dry etching through the Bosch process from a front surface (first surface) of the support substrate 1.

Figure 8A:
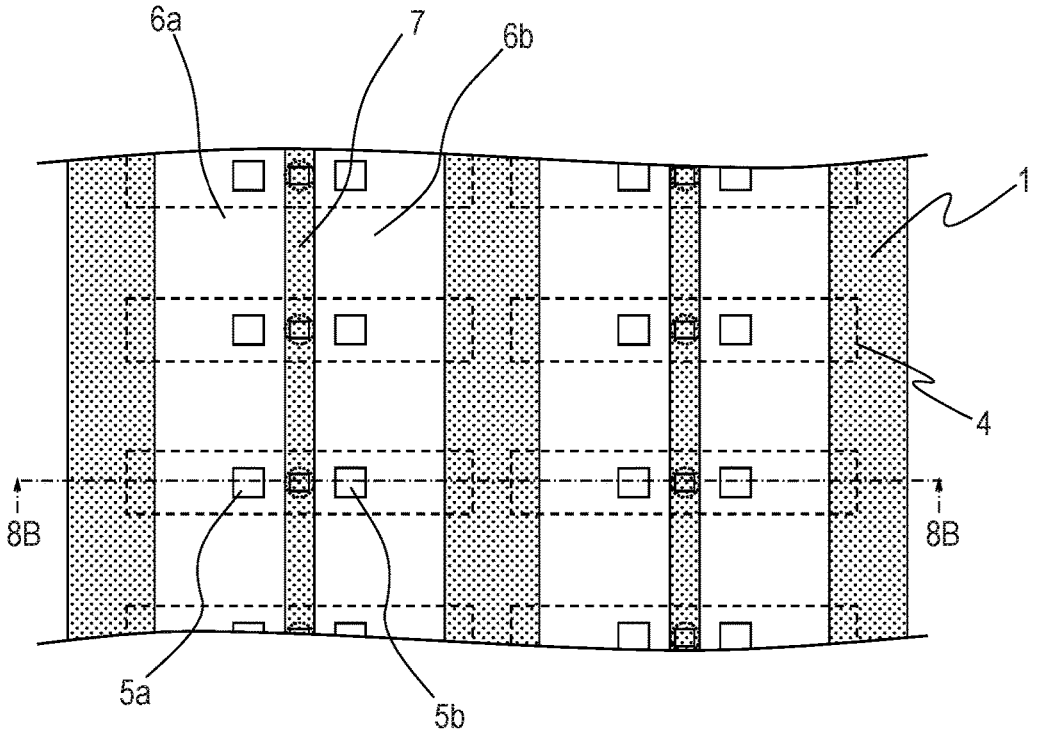
FIG. 8A PRIOR ART
FIG. 8A is a schematic plan view of the liquid ejection head substrate in which the width of a partition wall is decreased to reduce a refill distance when viewed from the common liquid chamber side.
Figure 8B:
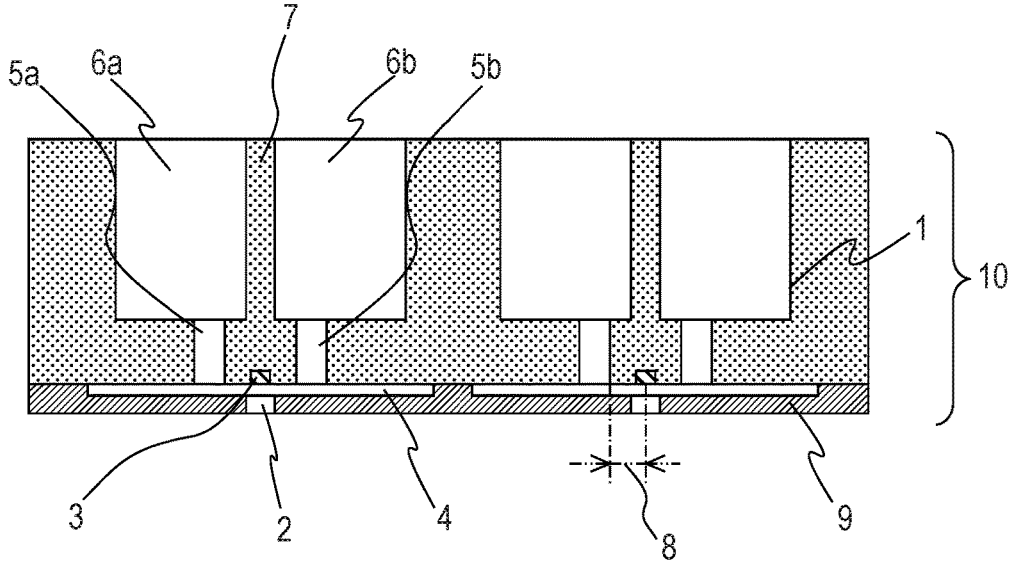
FIG. 8B PRIOR ART
FIG. 8B is a schematic sectional view taken along the line 8B-8B of FIG. 8A.

Then, as illustrated in an enlarged view of FIG. 7B, it is known that an etching defect (burr) 11 occurs in the crank-shaped portion, and it is difficult to process the connection portion with satisfactory accuracy. Therefore, the distance from the independent liquid chamber 5 to the partition wall is required to be equal to or more than a certain distance. As described above, when only the independent liquid chamber 5 is brought close to the pressure generating element 3, there is a limit of a range in which the refill distance 8 can be reduced. Thus, in order to form the independent liquid chamber 5 and the common liquid chamber 6 in a coupled manner with satisfactory accuracy and reduce the refill distance 8, it is desired to bring both the independent liquid amber 5 and the common liquid chamber 6 close to the pressure generating element 3, that is, to decrease the width of the partition wall 7 and maintain the distance from the independent liquid chamber 5 to the partition wall 7. An example of the liquid ejection head substrate in which the width of the partition wall 7 is decreased is illustrated in FIG. 8A and FIG. 8B. In this case, the width of the partition wall 7 is decreased to reduce the refill distance 8 while the distance from the independent liquid chamber 5 to the partition wall 7 is ensured, but the mechanical strength of the partition wall 7 is decreased due to the decrease in thickness of the partition wall 7. When the mechanical strength of the partition wall 7 is decreased, substrate conveyance impact during a manufacturing process after the independent liquid chamber 5 and the common liquid chamber 6 are processed and physical impact during a process treatment (for example, ultrasonic treatment and chemical solution oscillation cleaning) cause chipping and cracking of the partition wall 7, resulting in decrease in yield.

In view of the foregoing, in the liquid ejection head substrate according to one embodiment of the present invention, the width of the partition wall 7 is decreased while the mechanical strength thereof is not decreased, to thereby enable both the independent liquid chamber and the common liquid chamber to be brought close to the pressure generating element. That is, the liquid ejection head substrate according to one embodiment of the present invention has the following feature. In the liquid ejection head substrate, a plurality of units are arranged. Each of the plurality of units includes: a pressure generating element formed on a first surface of a support substrate; and a pair of independent liquid chambers, which are formed on both sides of the pressure generating element so as to be opposed to each other, and are opened to the first surface of the support substrate. The liquid ejection head substrate includes, in the support substrate: a first common liquid chamber communicating to a plurality of independent liquid chambers on one side of the pair of independent liquid chambers; a second common liquid chamber communicating to a plurality of independent liquid chambers on another side of the pair of independent liquid chambers; and a partition wall separating the first common liquid chamber and the second common liquid chamber from each other. The partition wall extends in an arrangement direction of the units. The partition wall has a width smaller than a distance between the pair of independent liquid chambers and has a shape inflected regularly in the arrangement direction in plan view of the support substrate in a thickness direction thereof.

Now, embodiments of the present invention are described below by giving examples, but the present invention is not limited to those embodiments.

[First Embodiment]

Figure 1A:
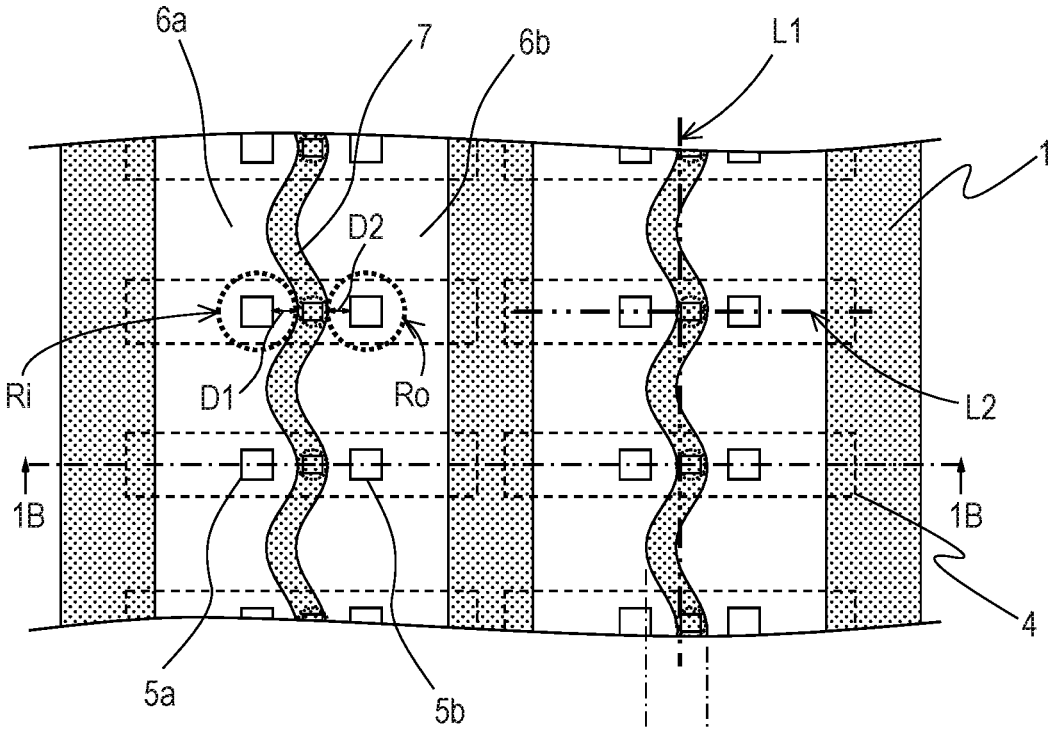
Figure 1B:
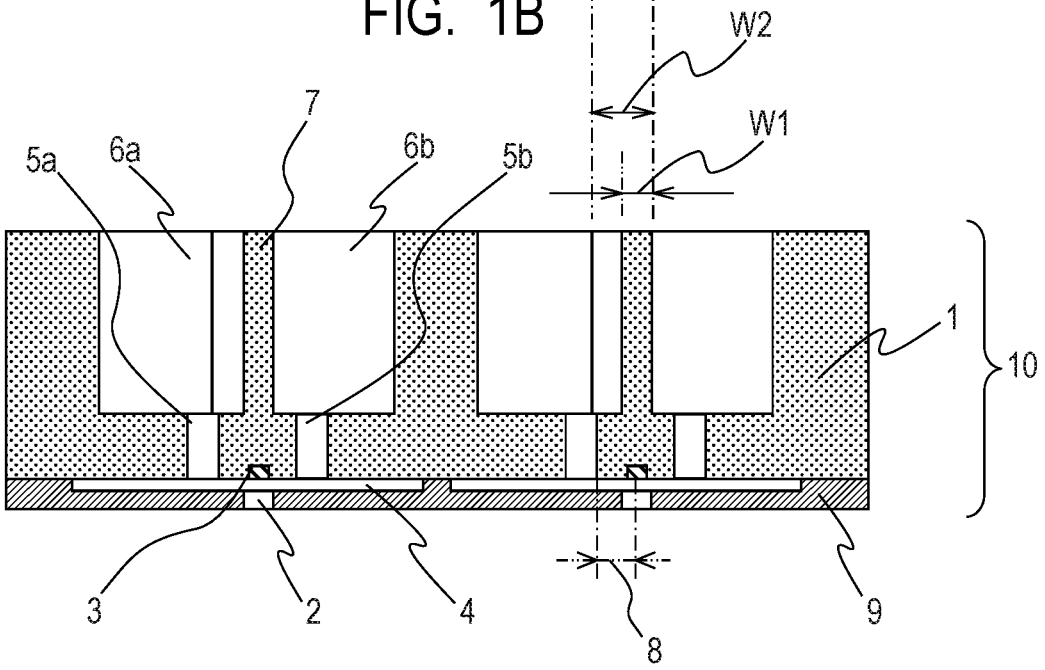

FIG. 1A and FIG. 1B are each a view for illustrating a liquid ejection head substrate according to a first embodiment of the present invention. FIG. 1A is a schematic plan view of the liquid ejection head substrate when viewed from a common liquid chamber side, and FIG. 1B is a schematic sectional view taken along the line 1B-1B of FIG. 1A. A partition wall 7 is formed so as to extend in a wavy line shape as a shape inflected regularly in an arrangement direction of pressure generating elements 3 in plan view. When the wavy line shape is defined by a center line of the width of the partition wall 7, a local radius of curvature of the wavy line shape and a rate of change of the radius of curvature can be set freely. For example, a wavy line drawing a sine curve having a constant radius of curvature can be adopted. Independent liquid chambers 5 can also be arranged freely with respect to the partition wall 7. For example, as illustrated in FIG. 1A and FIG. 1B, a pair of independent liquid chambers 5*a* and 5*b* communicating to one pressure generating chamber 4 are arranged in a region Ri (concave portion) on an inner side of a curved surface and a region Ro (convex portion) on an outer side of the curved surface, respectively. Further, the pair of independent liquid chambers 5*a* and 5*b* are arranged so that a straight line L2 connecting the pair of independent liquid chambers 5*a* and 5*b* to each other is orthogonal to a center-of-gravity line L1 of the partition wall 7 having the wavy line shape, and that distances D1 and D2 from the pair of independent liquid chambers 5*a* and 5*b* to the partition wall 7 become equal to each other. In this configuration, the width of the partition wall 7 and the refill distance 8 are reduced, and the partition wall 7 has the wavy line shape. Therefore, even when a width W1 is decreased, the mechanical strength of the partition wall 7 is improved as compared to that of a partition wall having a straight line shape with the same width W1. Further, the partition wall 7 has a structure of being inflected regularly. Therefore, the refill distance for each unit becomes substantially equal to each other, and liquid can be supplied to the pressure generating element 3 with satisfactory balance.

When the distances D1 and D2 are reduced excessively, the same problem as that described with reference to FIG. 7A and FIG. 7B may occur depending on the shape of a base of the partition wall 7. It is preferred that the distances D1 and D2 be set to, for example, 5 μm or more.

When the width W1 of the partition wall 7 is decreased excessively, the strength of the partition wall 7 becomes insufficient even when the partition wall 7 is reinforced by changing the shape, leading to defects such as chipping and cracking of the partition wall 7. Therefore, it is preferred that the width W1 be 10 μm or more. Further, when a widened width W2 caused by inflection of the partition wall 7 becomes excessively large, the widened width W2 may have an effect on flowability of the liquid in a common liquid chamber 6. Therefore, it is preferred that the widened width W2 be a width equal to or less than a distance between opening centers of the pair of independent liquid chambers 5*a* and 5*b*.

Figure 2A:
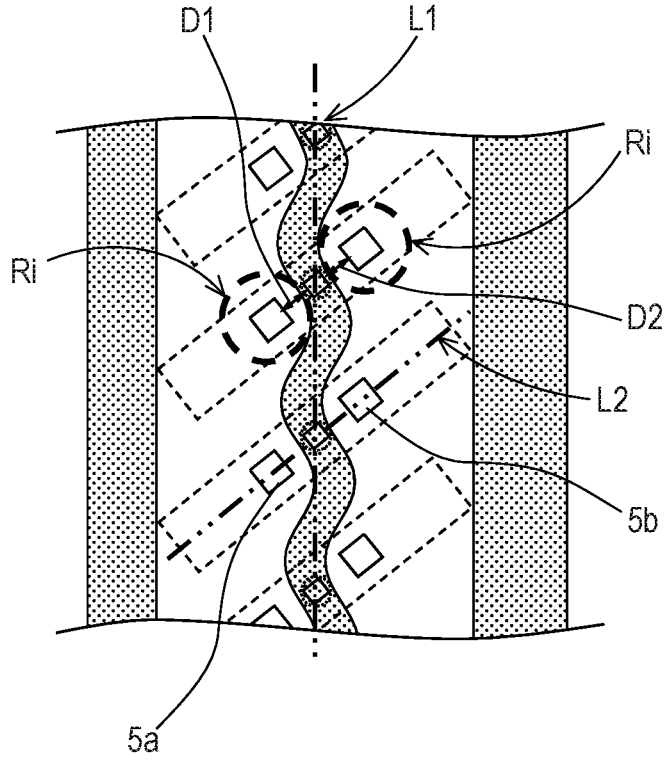
Figure 2B:
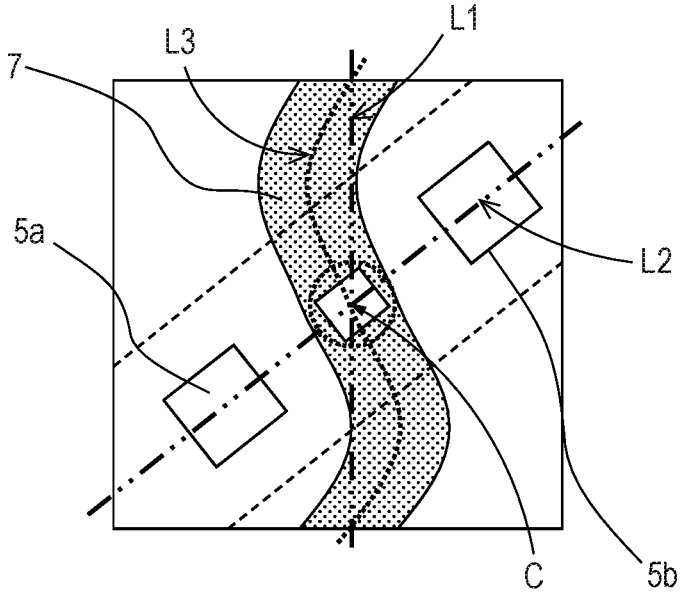

FIG. 2A and FIG. 2B are each a view for illustrating an example of more preferred arrangement of the pair of independent liquid chambers 5*a* and 5*b* as compared to FIG. 1A and FIG. 1B. When the independent liquid chamber 5 and the common liquid chamber 6 are formed by dry etching, an etching rate may be decreased in the vicinity of an etching side wall. For example, in the case of the example of FIG. 1A and FIG. 1B, of the pair of the independent liquid chambers 5*a* and 5*b*, one independent liquid chamber 5*a* is arranged in the region Ri, and the other independent liquid chamber 5*b* is arranged in the region Ro. Therefore, the depth of the independent liquid chambers 5*a* and 5*b* may vary. As illustrated in FIG. 2A and FIG. 2B, the pair of independent liquid chambers 5*a* and 5*b* are arranged in the regions Ri of the partition wall 7. Further, the pair of independent liquid chambers 5*a* and 5*b* are arranged so that a straight line L2 connecting opening centers of the pair of independent liquid chambers 5*a* and 5*b* to each other passes through an intersection C between a center-of-gravity line L1 in an extending direction of the partition wall 7 having the wavy line shape and a center line L3 of a width of the partition wall 7, and that the distance D1 from the independent liquid chamber 5*a* to the partition wall 7 and the distance D2 from the independent liquid chamber 5*b* to the partition wall 7 are equal to each other (D1/D2=1). With such arrangement, in addition to the effect of the configuration illustrated in FIG. 1A and FIG. 1B, the environments of the independent liquid chambers 5*a* and 5*b* in terms of its positional relationship with the partition wall 7 become uniform, and hence variation in depth of the independent liquid chambers 5 can be reduced.

[Second Embodiment]

Figure 3A:
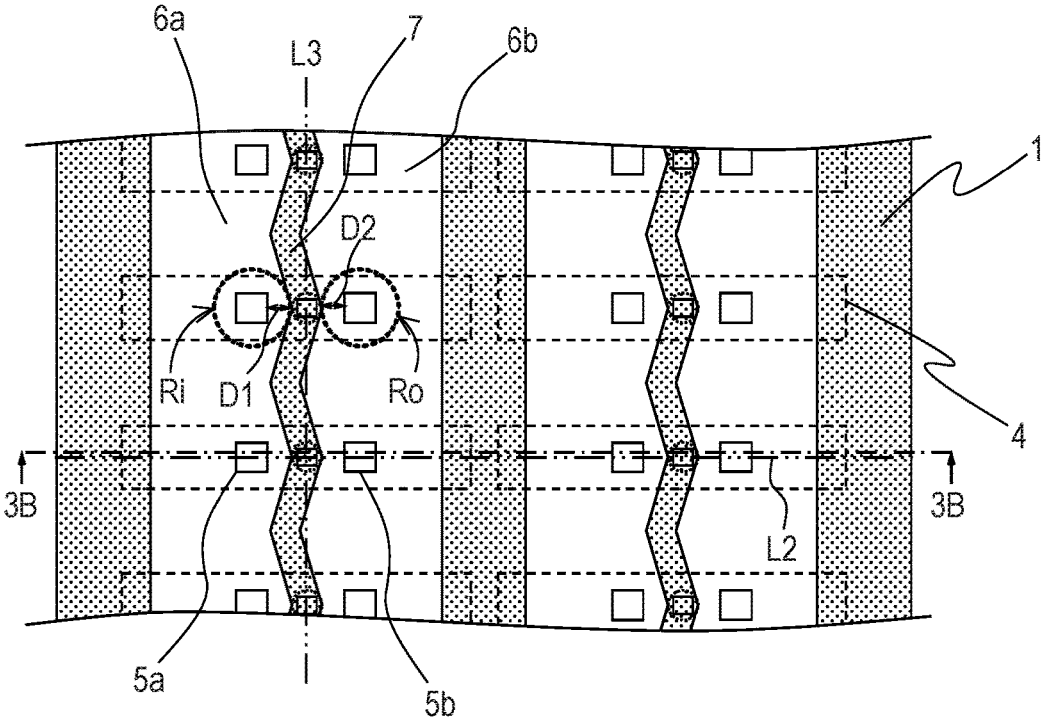
Figure 3B:
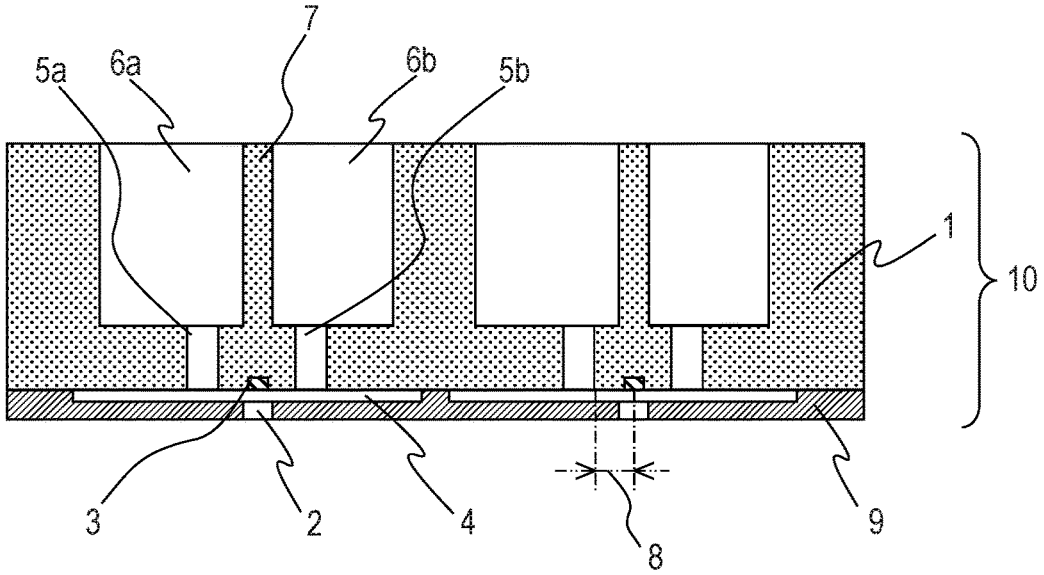

FIG. 3A and FIG. 3B are each a view for illustrating a liquid ejection head substrate according to a second embodiment of the present invention. FIG. 3A is a schematic plan view of the liquid ejection head substrate when viewed from a common liquid chamber side, and FIG. 3B is a schematic sectional view taken along the line 3B-3B of FIG. 3A. A partition wall 7 is formed so as to extend in a zigzag shape as a shape inflected regularly in an arrangement direction of pressure generating elements 3. In the zigzag shape, a folding angle, the length of a straight line portion, an angle with respect to the arrangement direction of the pressure generating elements 3, and the like can be set freely. Further, the independent liquid chamber 5 can also be arranged freely. For example, as illustrated in FIG. 3A and FIG. 3B, the pair of independent liquid chambers 5*a* and 5*b* communicating to one pressure generating chamber 4 are arranged in a region Ri (valley) on an inner side of the zigzag shape and a region Ro (mountain) on an outer side of the zigzag shape. Further, the pair of independent liquid chambers 5*a* and 5*b* are arranged so that a straight line L2 connecting the pair of independent liquid chambers 5*a* and 5*b* to each other is orthogonal to a center-of-gravity line L3 of a zigzag shape of the partition wall 7, and that the distances D1 and D2 from the independent liquid chambers 5*a* and 5*b* to the partition wall 7 are equal to each other. Also with this arrangement, even when the width of the partition wall 7 is decreased, the mechanical strength of the partition wall 7 can be ensured by virtue of the zigzag shape. The refill distance 8 becomes shorter, and the distances from the independent liquid chambers 5*a* and 5*b* to the partition wall 7 are equal to each other. Therefore, the liquid can be supplied to the pressure generating element 3 with satisfactory balance.

Figure 4A:
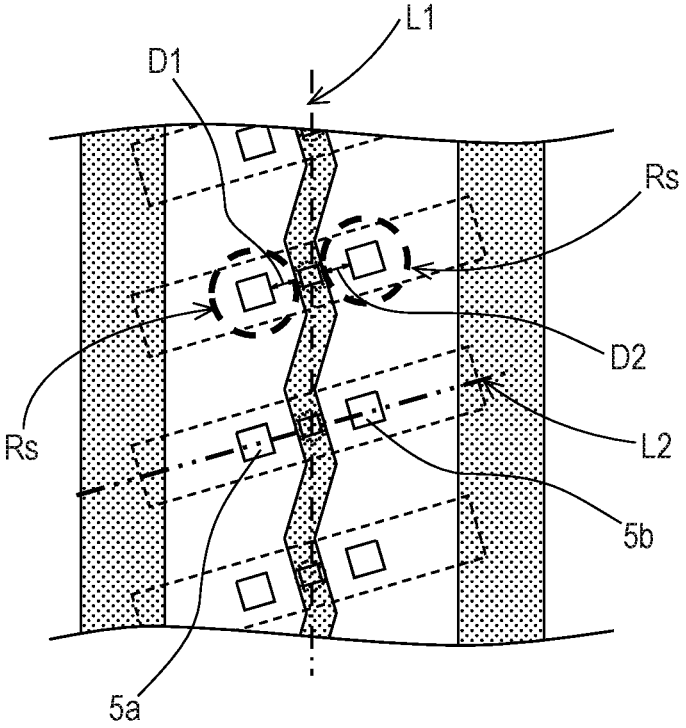
Figure 4B:
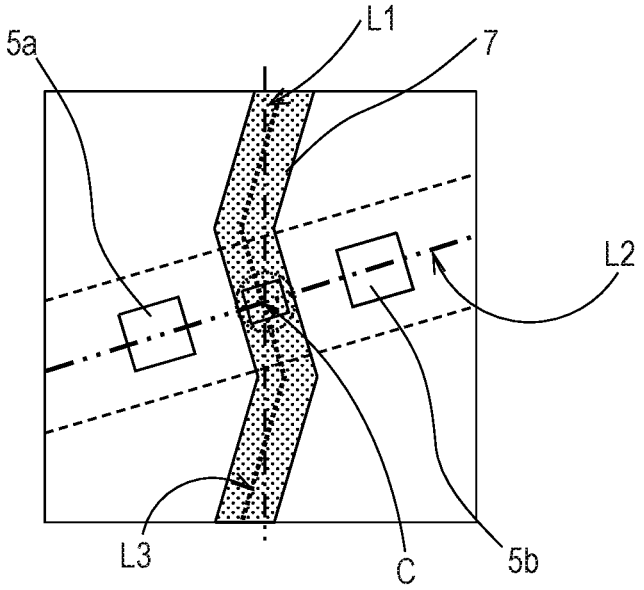

FIG. 4A and FIG. 4B are each a view for illustrating an example of more preferred arrangement of the independent liquid chambers 5 as compared to FIG. 3A and FIG. 3B. In the case of the example of FIG. 3A and FIG. 3B, of the pair of the independent liquid chambers 5*a* and 5*b*, one independent liquid chamber 5*a* is arranged in the region Ri on an inner side of the zigzag shape, and the other independent liquid chamber 5*b* is arranged in the region Ro on an outer side of the zigzag shape. Therefore, similarly to the case of the wavy line shape of FIG. 1A and FIG. 1B, the depth of the independent liquid chambers 5*a* and 5*b* may vary. As illustrated in FIG. 4A and FIG. 4B, the pair of independent liquid chambers 5*a* and 5*b* are arranged so as to be opposed in regions Rs of the partition wall 7. Further, the pair of independent liquid chambers 5*a* and 5*b* are arranged so that the straight line L2 connecting opening centers of the pair of independent liquid chambers 5*a* and 5*b* to each other passes through an intersection C between the center-of-gravity line L1 in the extending direction of the partition wall 7 having the zigzag shape and a center line L3 of a width of the partition wall 7, and that the distance D1 from the independent liquid chamber 5*a* to the partition wall 7 and the distance D2 from the independent liquid chamber 5*b* to the partition wall 7 are equal to each other. With such arrangement, in addition to the effect of the configuration illustrated in FIG. 3A and FIG. 3B, the environments of the independent liquid chambers 5*a* and 5*b* in terms of its positional relationship with the partition wall 7 become uniform, and hence variation in depth of the independent liquid chambers 5 can be reduced.

Figure 5A:
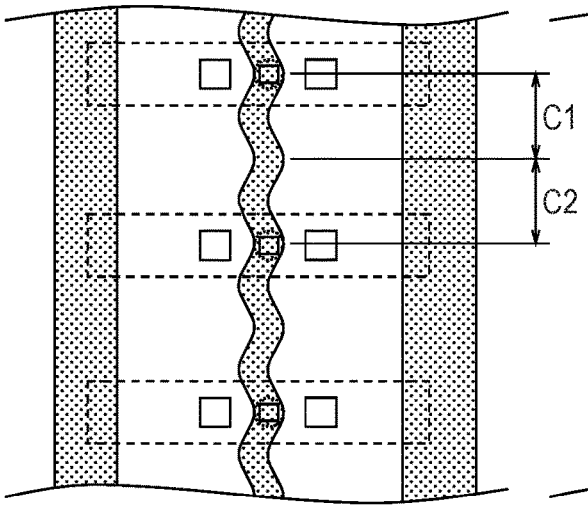
FIG. 5A, FIG. 5B, and FIG. 5C are each a schematic plan view of an example of a liquid ejection head substrate according to another embodiment of the present invention when viewed from a common liquid chamber side.

In the above-mentioned first and second embodiments, description is given of the structure in which one of the units is arranged for one cycle of the partition wall. However, for example, as illustrated in FIG. 5A, one of the units may be arranged for a plurality of cycles (two cycles in this case). In order to suppress variation in depth of the independent liquid chambers, the structure in which one of the units is arranged for one cycle of the partition wall is preferred.

Figure 5B:
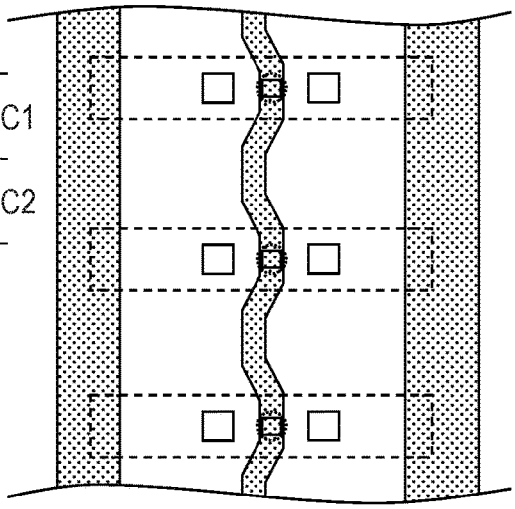
Figure 5C:
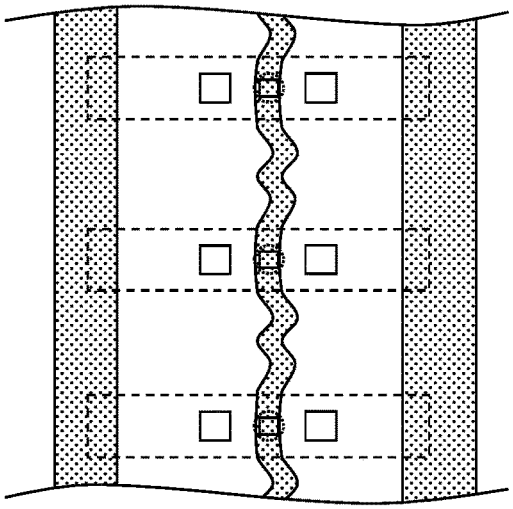

Further, the shape of the partition wall 7 inflected regularly is not limited to the above-mentioned wavy line shape or the zigzag shape, and may be an uneven shape as illustrated in FIG. 5B. Further, as illustrated in FIG. 5C, the partition wall 7 may have a shape in which the partition wall 7 is inflected regularly by a combination of a curved line and a straight line.

Further, in the above-mentioned first and second embodiments, the pair of independent liquid chambers are formed in such a manner that the distances D1 and D2 are equal to each other so that the pressure generating element 3 is formed above the partition wall 7, but the present invention is not limited thereto. However, a large difference between the distances D1 and D2 may deteriorate the balance of supply of the liquid and the stability of an ejection direction of the liquid from the ejection orifice. Therefore, it is preferred that the ratio (D1/D2) of the distances D1 and D2 fall within a range of from 0.9 to 1.1. Further, it is preferred that the pressure generating element 3 be arranged on the center-of-gravity line L1 of the partition wall 7.

The common liquid chamber and the independent liquid chamber are formed by perpendicularly etching the support substrate 1 as described above. As the support substrate 1, it is preferred to process one silicon substrate rather than a structure in which two silicon substrates are bonded to each other through intermediation of an intermediate layer as described in Japanese Patent Application Laid-Open No. 2011-161915. When the width of the partition wall 7 is decreased, the partition wall 7 is liable to be peeled to drop from the intermediate layer in the substrate including the intermediate layer.

A liquid ejection head using the liquid ejection head substrate 10 according to one embodiment of the present invention includes, on the first surface of the support substrate 1, one pressure generating chamber 4 communicating to the pair of independent liquid chambers 5*a* and 5*b* for each unit formed of the pressure generating element 3 and the pair of independent liquid chambers 5*a* and 5*b*. Further, the liquid ejection head includes, on the first surface of the support substrate 1, the ejection orifice member 9 having the ejection orifice 2 communicating to the pressure generating chamber 4. The liquid ejection head is capable of circulating liquid in the pressure generating chamber 4 from one of the first and second common liquid chambers 6*a* and 6*b* to the other through the pair of independent liquid chambers 5*a* and 5*b*. For example, the liquid can be circulated with the first common liquid chamber 6*a* serving as a supply side and the second common liquid chamber 6*b* serving as a discharge side.

EXAMPLES

Now, the present invention is more specifically described by way of Examples.

Example 1

Example 1 is described with reference to FIG. 1A and FIG. 1B. The pressure generating chamber 4 has a height of 10 μm. The independent liquid chamber 5 had an opening portion in a square shape having a planar dimension of 50 μm×50 μm, and the depth of the independent liquid chamber 5 was set to 100 μm. The common liquid chamber 6 had a planar dimension of 200 μm (width from a convex portion of the partition wall 7 in a direction orthogonal to the arrangement direction)×20,000 μm (length of the arrangement direction) and a depth of 300 μm, and was formed in a silicon substrate serving as the support substrate 1. Simultaneously, the partition wall 7 having the wavy line shape was formed regularly so as to meander in a right-and-left direction of FIG. 1A with a width of 50 μm, a minimum radius of curvature of 100 μm, and a maximum radius of curvature of 200 μm. The pair of independent liquid chambers 5*a* and 5*b* configured to supply and discharge the liquid were caused to communicate to the pressure generating chamber 4. The common liquid chamber and the independent liquid chamber were formed by dry etching through the Bosch process using sulfur hexafluoride and fluorocarbon gas. The independent liquid chambers 5*a* and 5*b* were arranged so that the straight line L2 connecting the pair of independent liquid chambers 5*a* and 5*b* to each other was orthogonal to the center-of-gravity line L1 of the partition wall 7 having the wavy line shape. The independent liquid chamber 5*a* was arranged in the region Ri on an inner side of a curved surface of the wavy line of the partition wall 7, and the independent liquid chamber 5*b* was arranged in the region Ro on an outer side of the curved surface of the wavy line of the partition wall 7. The refill distance 8 in this case was 75 μm. The refill distance 8 in this case became shorter than the refill distance 8 of 100 μm in the case of the partition wall 7 having a straight shape as illustrated in FIG. 6A. Regarding the depth of each of the pair of independent liquid chambers 5*a* and 5*b*, the independent liquid chamber 5*a* arranged in the region Ri had a depth of 90 μm, and the independent liquid chamber 5*b* arranged in the region Ro had a depth of 100 μm. Thus, there was variation in depth of 10 μm.

In the liquid ejection head substrate including the partition wall 7 having the wavy line shape, no defects such as chipping and cracking of the partition wall 7 were found during a manufacturing process therefor, and the refill distance 8 was also able to be reduced.

Example 2

Example 2 is described with reference to FIG. 2A and FIG. 2B. Example 2 is the same as Example 1 except for the arrangement of the independent liquid chambers 5.

The pair of independent liquid chambers 5*a* and 5*b* were arranged in the respective regions Ri on an inner side of the curved surface of the wavy line of the partition wall 7. The pair independent liquid chambers 5*a* and 5*b* were arranged so that the straight line L2 connecting the pair of independent liquid chambers 5*a* and 5*b* to each other passed through an intersection between the center-of-gravity line L1 of the wavy line and the center line L3, and that the distance D1 from the independent liquid chamber 5*a* to the partition wall 7 and the distance D2 from the independent liquid chamber 5*b* to the partition wall 7 were each 50 μm, that is, were equal to each other. The refill distance 8 in this case was 75 μm. The refill distance 8 in this case became shorter than the refill distance 8 of 100 μm in the case of the partition wall 7 having the straight shape as illustrated in FIG. 6A. The depth of each of the pair of independent liquid chambers 5*a* and 5*b* was 100 μm, and there was no variation in depth. Thus, variation in depth of the independent liquid chambers 5 was able to be suppressed as compared to Example 1.

No defects such as chipping and cracking of the partition wall 7 were found during a manufacturing process, and the refill distance 8 was also able to be reduced.

Example 3

Example 3 is described with reference to FIG. 2A and FIG. 2B. Example 3 is the same as Example 2 except that the distances D1 and D2 were set to 50 μm and 55 μm, respectively.

The refill distance 8 in this case was 75 μm on the independent liquid chamber 5*a* side and 80 μm on the independent liquid chamber 5*b* side. The refill distance 8 in this case became shorter than the refill distance 8 of 100 μm in the case of the partition wall 7 having the straight shape as illustrated in FIG. 6A. Regarding the depth of each of the pair of independent liquid chambers 5*a* and 5*b*, the depth of the independent liquid chamber 5*a* was 100 μm, and the depth of the independent liquid chamber 5*b* was 102 μm. Thus, variation in depth of the independent liquid chambers 5 was able to be suppressed as compared to Example 1.

No defects such as chipping and cracking of the partition wall 7 were found during a manufacturing process, and the refill distance 8 was also able to be reduced.

Example 4

Example 4 is described with reference to FIG. 3A and FIG. 3B. Example 4 is the same as Example 1 except for the shape of the partition wall 7 and the arrangement of the independent liquid chamber 5.

The partition wall 7 was formed regularly so as to be folded in a zigzag shape at 150° in a right-and-left direction with a width of 50 μm and a length of a straight line portion of 125 μm. The pair of independent liquid chambers 5*a* and 5*b* were arranged so that the straight line L2 connecting the pair of independent liquid chambers 5*a* and 5*b* to each other was orthogonal to the center-of-gravity line L1 of the partition wall 7 having the zigzag shape. The independent liquid chamber 5*a* was arranged in the region Ri on an inner side of the zigzag shape of the partition wall 7, and the independent liquid chamber 5*b* was arranged in the region Ro on an outer side of the zigzag shape of the partition wall 7. The refill distance 8 in this case was 75 μm. The refill distance 8 in this case became shorter than the refill distance 8 of 100 μm in the case of the partition wall 7 having the straight shape as illustrated in FIG. 6A. Regarding the depth of each of the pair of independent liquid chambers 5*a* and 5*b*, the depth of the independent liquid chamber 5*a* arranged in the region Ri was 90 μm, and the depth of the independent liquid chamber 5*b* arranged in the region Ro was 100 μm. Thus, there was variation in depth of 10 μm.

Even in the liquid ejection head substrate including the partition wall 7 having the zigzag shape, no defects such as chipping and cracking of the partition wall 7 were found during a manufacturing process therefor, and the refill distance 8 was also able to be reduced.

Example 5

Example 5 is described with reference to FIG. 4A and FIG. 4B. Example 5 is the same as Example 1 except for the shape of the partition wall 7 and the arrangement of the independent liquid chamber 5. Further, the shape of the partition wall 7 is the same as that of Example 4.

The pair of independent liquid chambers 5*a* and 5*b* were arranged so as to be opposed to each other in the respective straight line portions Rs of the zigzag shape of the partition wall 7. The pair of independent liquid chambers 5*a* and 5*b* were arranged so that the straight line L2 connecting the pair of independent liquid chambers 5*a* and 5*b* to each other passed through an intersection between the center-of-gravity line L1 of the zigzag shape and the center line L3 of the zigzag shape, and the distance D1 from the independent liquid chamber 5*a* to the partition wall 7 and the distance D2 from the independent liquid chamber 5*b* to the partition wall 7 were each 50 μm, that is, were equal to each other. The refill distance 8 in this case was 75 μm. The refill distance 8 in this case became shorter than the refill distance 8 of 100 μm in the case of the partition wall 7 having the straight shape as illustrated in FIG. 6A. The depth of each of the pair of independent liquid chambers 5*a* and 5*b* was 100 μm, and there was no variation in depth. Thus, variation in depth of the independent liquid chamber 5 was able to be suppressed as compared to Example 4.

No defects such as chipping and cracking of the partition wall 7 were found during a manufacturing process, and the refill distance 8 was also able to be reduced.

Example 6

Example 6 is described with reference to FIG. 4A and FIG. 4B. Example 6 is the same as Example 5 except that the distances D1 and D2 from the partition wall 7 were set to 50 μm and 55 μm, respectively.

The refill distance 8 in this case was 75 μm on the independent liquid chamber 5*a* side and 80 μm on the independent liquid chamber 5*b* side. The refill distance 8 in this case became shorter than the refill distance 8 of 100 μm in the case of the partition wall 7 having the straight shape as illustrated in FIG. 6A. Regarding the depth of each of the pair of independent liquid chambers 5*a* and 5*b*, the depth of the independent liquid chamber 5*a* was 100 μm, and the depth of the independent liquid chamber 5*b* was 102 μm. Thus, variation in depth was able to be suppressed as compared to Example 4.

No defects such as chipping and cracking of the partition wall 7 were found during a manufacturing process therefor, and the refill distance 8 was also able to be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-120616, filed Jun. 20, 2017, which is hereby incorporated by reference herein in its entirety.

What is claimed is:

1. A liquid ejection head substrate, in which a plurality of units are arranged, each of the plurality of units including:

a pressure generating element formed on a first surface of a support substrate; and a pair of independent liquid chambers, which are formed on both sides of the pressure generating element so as to be opposed to each other, and are opened to the first surface of the support substrate, the liquid ejection head substrate comprising, in the support substrate:

a first common liquid chamber communicating to a plurality of independent liquid chambers on one side of the pair of independent liquid chambers;

a second common liquid chamber communicating to a plurality of independent liquid chambers on another side of the pair of independent liquid chambers; and a partition wall separating the first common liquid chamber and the second common liquid chamber from each other, wherein the partition wall extends in an arrangement direction of the pressure generating elements, wherein the partition wall has a width smaller than a distance between the pair of independent liquid chambers, wherein the partition wall has a shape inflected regularly in the arrangement direction in plan view of the support substrate in a thickness direction of the support substrate, and wherein the pair of independent liquid chambers of each of the plurality of units are arranged so that a straight line connecting opening centers of the pair of independent liquid chambers is orthogonal to a center-of-gravity line of the partition wall in an extending direction of the partition wall.

2. The liquid ejection head substrate according to claim 1, wherein one of the plurality of units is arranged for one cycle of the partition wall.

3. A liquid ejection head comprising:

the liquid ejection head substrate of claim 2; and a member, which is formed on the first surface of the support substrate, and includes:

one pressure generating chamber communicating to the pair of independent liquid chambers for each of the plurality of units; and an ejection orifice communicating to the one pressure generating chamber, wherein the liquid ejection head is capable of circulating liquid in the one pressure generating chamber from one of the first common liquid chamber and the second common liquid chamber to another of a first liquid chamber and a second liquid chamber through the pair of independent liquid chambers.

4. The liquid ejection head substrate according to claim 1, wherein the shape inflected regularly of the partition wall includes a wavy line shape.

5. The liquid ejection head substrate according to claim 1, wherein the shape inflected regularly of the partition wall includes a zigzag shape.

6. The liquid ejection head substrate according to claim 1, further comprising, on the first surface of the support substrate, a member including:

one pressure generating chamber communicating to the pair of independent liquid chambers for each of the plurality of units; and an ejection orifice communicating to the one pressure generating chamber.

7. A liquid ejection head comprising:

the liquid ejection head substrate of claim 1; and a member, which is formed on the first surface of the support substrate, and includes:

one pressure generating chamber communicating to the pair of independent liquid chambers for each of the plurality of units; and an ejection orifice communicating to the one pressure generating chamber, wherein the liquid ejection head is capable of circulating liquid in the one pressure generating chamber from one of the first common liquid chamber and the second common liquid chamber to another of a first liquid chamber and a second liquid chamber through the pair of independent liquid chambers.

8. A liquid ejection head substrate, in which a plurality of units are arranged, each of the plurality of units including:

a pressure generating element formed on a first surface of a support substrate; and a pair of independent liquid chambers, which are formed on both sides of the pressure generating element so as to be opposed to each other, and are opened to the first surface of the support substrate, the liquid ejection head substrate comprising, in the support substrate:

a first common liquid chamber communicating to a plurality of independent liquid chambers on one side of the pair of independent liquid chambers;

a second common liquid chamber communicating to a plurality of independent liquid chambers on another side of the pair of independent liquid chambers; and a partition wall separating the first common liquid chamber and the second common liquid chamber from each other, wherein the partition wall extends in an arrangement direction of the pressure generating elements, wherein the partition wall has a width smaller than a distance between the pair of independent liquid chambers, wherein the partition wall has a shape inflected regularly in the arrangement direction in plan view of the support substrate in a thickness direction of the support substrate, and wherein the pair of independent liquid chambers of each of the plurality of units are arranged so that a straight line connecting opening centers of the pair of independent liquid chambers is prevented from being orthogonal to a center-of-gravity line of the partition wall in an extending direction of the partition wall.

9. The liquid ejection head substrate according to claim 8, wherein one of the plurality of units is arranged for one cycle of the partition wall.

10. A liquid ejection head comprising:

the liquid ejection head substrate of claim 9; and a member, which is formed on the first surface of the support substrate, and includes:

one pressure generating chamber communicating to the pair of independent liquid chambers for each of the plurality of units; and an ejection orifice communicating to the one pressure generating chamber, wherein the liquid ejection head is capable of circulating liquid in the one pressure generating chamber from one of the first common liquid chamber and the second common liquid chamber to another of a first liquid chamber and a second liquid chamber through the pair of independent liquid chambers.

11. The liquid ejection head substrate according to claim 8, wherein the shape inflected regularly of the partition wall includes a wavy line shape.

12. The liquid ejection head substrate according to claim 8, wherein the shape inflected regularly of the partition wall includes a zigzag shape.

13. The liquid ejection head substrate according to claim 8, wherein a ratio (D1/D2) of a distance D1 from an opening end on the pressure generating element side of each of the plurality of independent liquid chambers on the one side of the pair of independent liquid chambers to the partition wall to a distance D2 from an opening end on the pressure generating element side of each of the plurality of independent liquid chambers on the another side of the pair of independent liquid chambers to the partition wall falls within a range of from 0.9 to 1.1.

14. The liquid ejection head substrate according to claim 8, further comprising, on the first surface of the support substrate, a member including:

one pressure generating chamber communicating to the pair of independent liquid chambers for each of the plurality of units; and an ejection orifice communicating to the one pressure generating chamber.

15. A liquid ejection head comprising:

the liquid ejection head substrate of claim 8; and a member, which is formed on the first surface of the support substrate, and includes:

one pressure generating chamber communicating to the pair of independent liquid chambers for each of the plurality of units; and an ejection orifice communicating to the one pressure generating chamber, wherein the liquid ejection head is capable of circulating liquid in the one pressure generating chamber from one of the first common liquid chamber and the second common liquid chamber to another of a first liquid chamber and a second liquid chamber through the pair of independent liquid chambers.

* * * * *